United States Patent [19]

Piretti

[11] Patent Number: 4,909,472

[45] Date of Patent: Mar. 20, 1990

[54] PIVOTING SUPPORT FOR CHAIRS, SEATS AND THE LIKE

[75] Inventor: Giancarlo Piretti, Bologna, Italy

[73] Assignee: Pro-Cord S.r.l., Bologna, Italy

[21] Appl. No.: 192,190

[22] Filed: May 10, 1988

[30] Foreign Application Priority Data

May 20, 1987 [IT] Italy ..... 67443 A/87

[51] Int. Cl.[4] ..... F16M 13/00

[52] U.S. Cl. ..... 248/578; 297/302; 297/304

[58] Field of Search ..... 248/575, 576, 577, 578, 248/580, 581, 584, 589, 592, 593, 594, 595, 596, 598, 618, 619, 629, 371, 372.1, 398; 297/267, 265, 301, 300, 302, 304, 305, 325, 326

[56] References Cited

U.S. PATENT DOCUMENTS

| | | | |
|---|---|---|---|
| 981,939 | 1/1911 | Persons | 248/619 |
| 1,075,106 | 10/1913 | Holt | 248/619 |
| 1,346,110 | 7/1920 | Atwood | 248/596 |
| 2,184,988 | 12/1939 | Collier | 248/596 |
| 2,620,855 | 12/1952 | Stone | 248/595 |
| 2,968,483 | 1/1961 | Dodson | 248/584 |
| 3,285,562 | 11/1966 | Langer | 248/575 |
| 3,319,920 | 5/1967 | Freedman | 248/576 |
| 3,599,232 | 8/1971 | Tabor | 248/575 |
| 3,627,252 | 12/1971 | Yamaguchi | 248/598 |
| 4,408,800 | 10/1983 | Knapp | 248/631 |

FOREIGN PATENT DOCUMENTS

| | | | |
|---|---|---|---|
| 79530 | 5/1983 | European Pat. Off. | 297/325 |

*Primary Examiner*—Ramon O. Ramirez
*Assistant Examiner*—Robert A. Olson
*Attorney, Agent, or Firm*—Fuller, Puerner & Hohenfeldt

[57] ABSTRACT

A pivoting support for chairs, seats and the like comprises a main support member which is connected to the base structure of the chair and a seat support member which is pivotably connected to the main support member with the interposition of an auxiliary support member. The latter is articulated to the main support member about a first horizontal axis and to the seat support member about a second horizontal axis parallel to and in front of the first horizontal axis. First resilient means are interposed between the main support member and the seat support member for biassing the seat support member towards a position in which it is rotated upwardly relative to the auxiliary support element. Second resilient means are also interposed between the main support member and the auxiliary support member for biassing the auxiliary support member towards a position in which it is rotated upwardly relative to the main support member. The user can pivot the seat backwards by downward rotation of the seat support element relative to the auxiliary support element, overcoming the action of the first resilient means, or forwards by downward rotation of the auxiliary support member relative to the main support member, overcoming the action of the first and second resilient means.

7 Claims, 6 Drawing Sheets

PIVOTING SUPPORT FOR CHAIRS, SEATS AND THE LIKE

DESCRIPTION

The present invention relates to pivoting supports for chairs, seats and the like, of the type comprising a main support member which is connected to the base structure of the chair, and a seat support member which is connected to the main support member for pivoting about a horizontal axis.

The use of supports of this type has been known for some time and enables the user to pivot the chair, from a normal condition of use, backwards to achieve a relaxed position, or forwards to achieve a position which is more suitable for the operation of the keyboard of a typewriter or a terminal.

The object of the present invention is to produce a support of the above-indicated type which has a simple and functional structure.

The main characteristic of the support according to the invention lies in the fact that the seat support member is connected to the main support member with the interposition of an auxiliary support member, in that the auxiliary support member is articulated to the main support member about a first horizontal axis and to the seat support member about a second horizontal axis which is parallel to and in front of the first horizontal axis, in that first resilient means are interposed between the main support member and the seat support member for biasing the seat support member towards a position in which it is rotated upwardly relative to the auxiliary support member, and in that second resilient means are interposed between the main support member and the auxiliary support member for biasing the auxiliary support member towards a position in which it is rotated upwardly relative to the main support member.

The main support member, the seat support member and the auxiliary support member have stop surfaces which cooperate with each other to delimit the upwardly rotated position of the seat support member relative to the auxiliary support member and the upwardly rotated position of the auxiliary support member relative to the main support member.

By the displacement of his own weight, the user can pivot the seat backwards by the downward rotation of the seat support member relative to the auxiliary support member, overcoming the action of the first resilient means, or forwards by the downward rotation of the auxiliary support member relative to the main support member, overcoming the action of the first and second resilient means.

Preferably, there are provided means for the adjustment of the first resilient means, as well as means for preventing the backward pivoting of the seat support member. If the main support member is connected to the upper end of a variable-length cylinder carried by the base structure of the chair, the support also includes means for adjustment of the cylinder.

Figure 1:
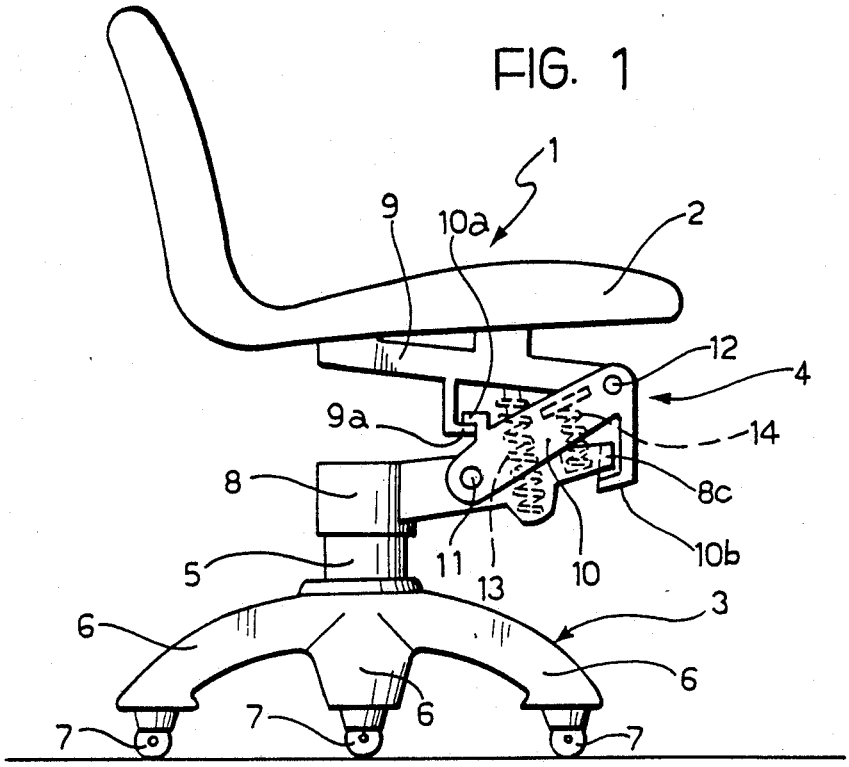
Figure 5:
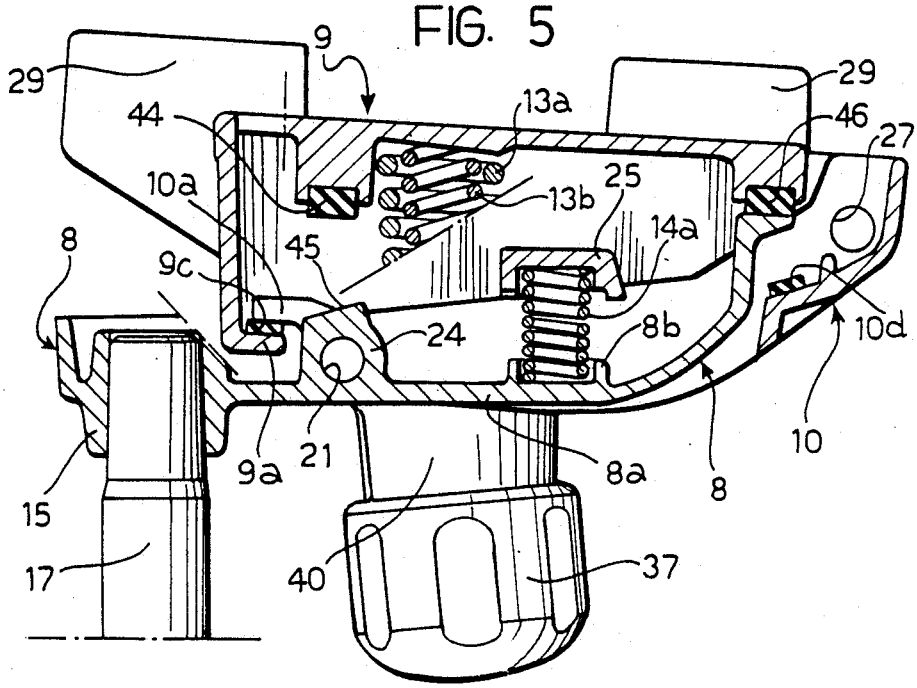
Figures 2, 11:
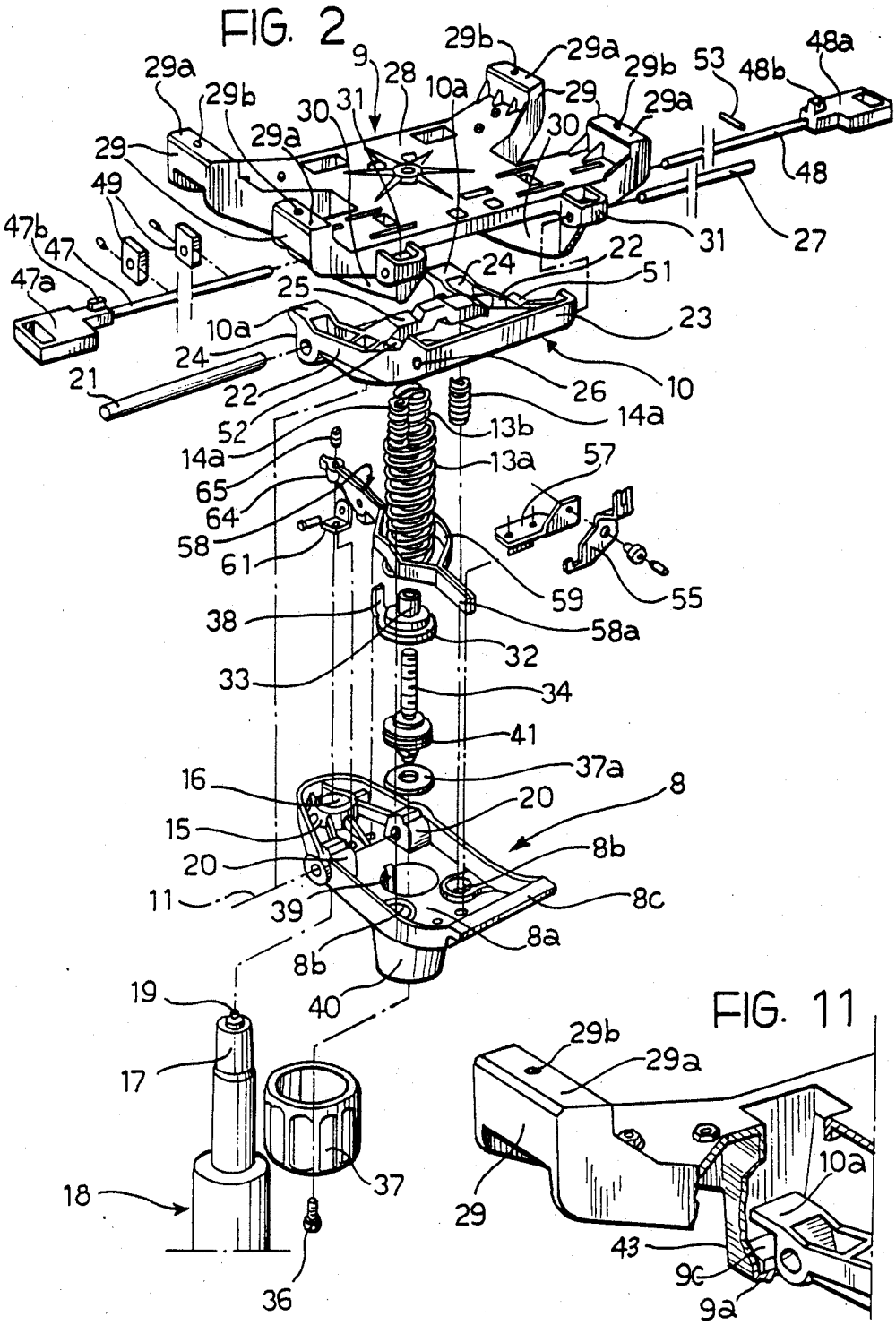
Figure 3:
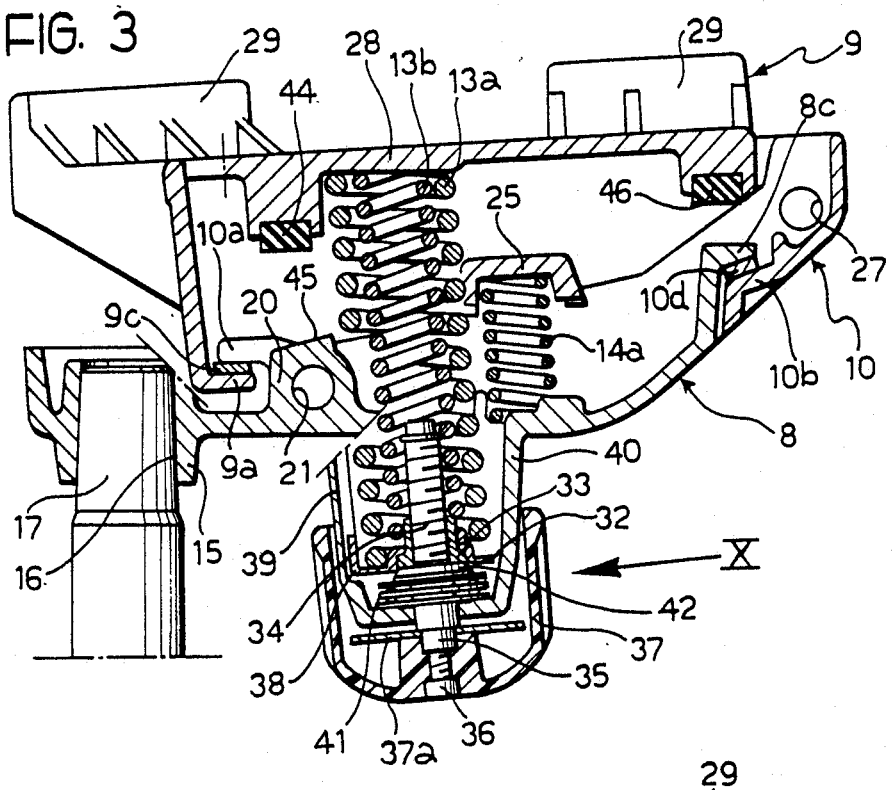
Figure 4:
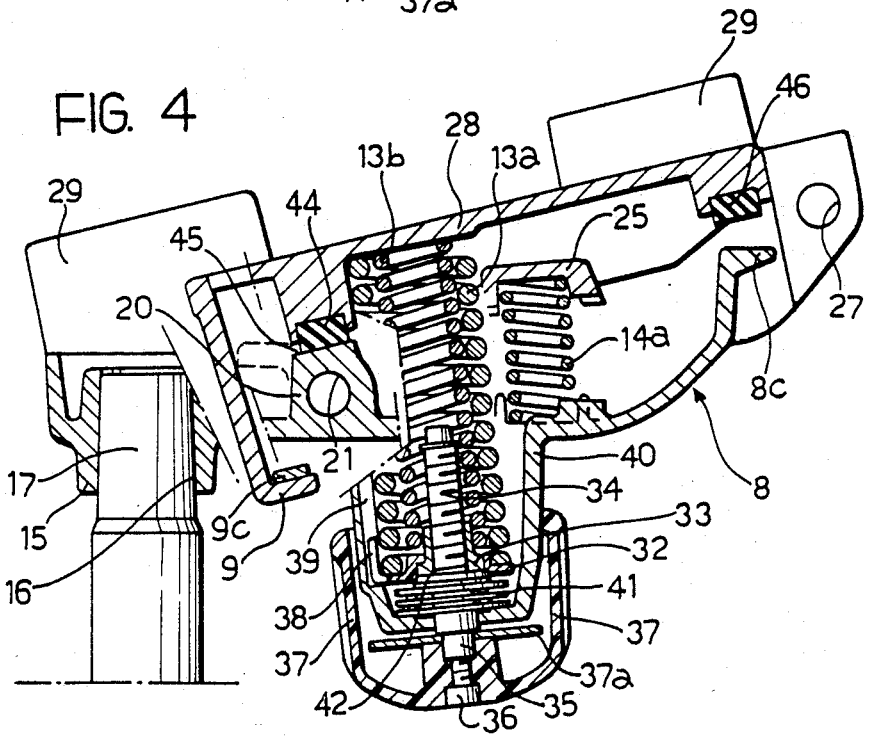
Figure 6:
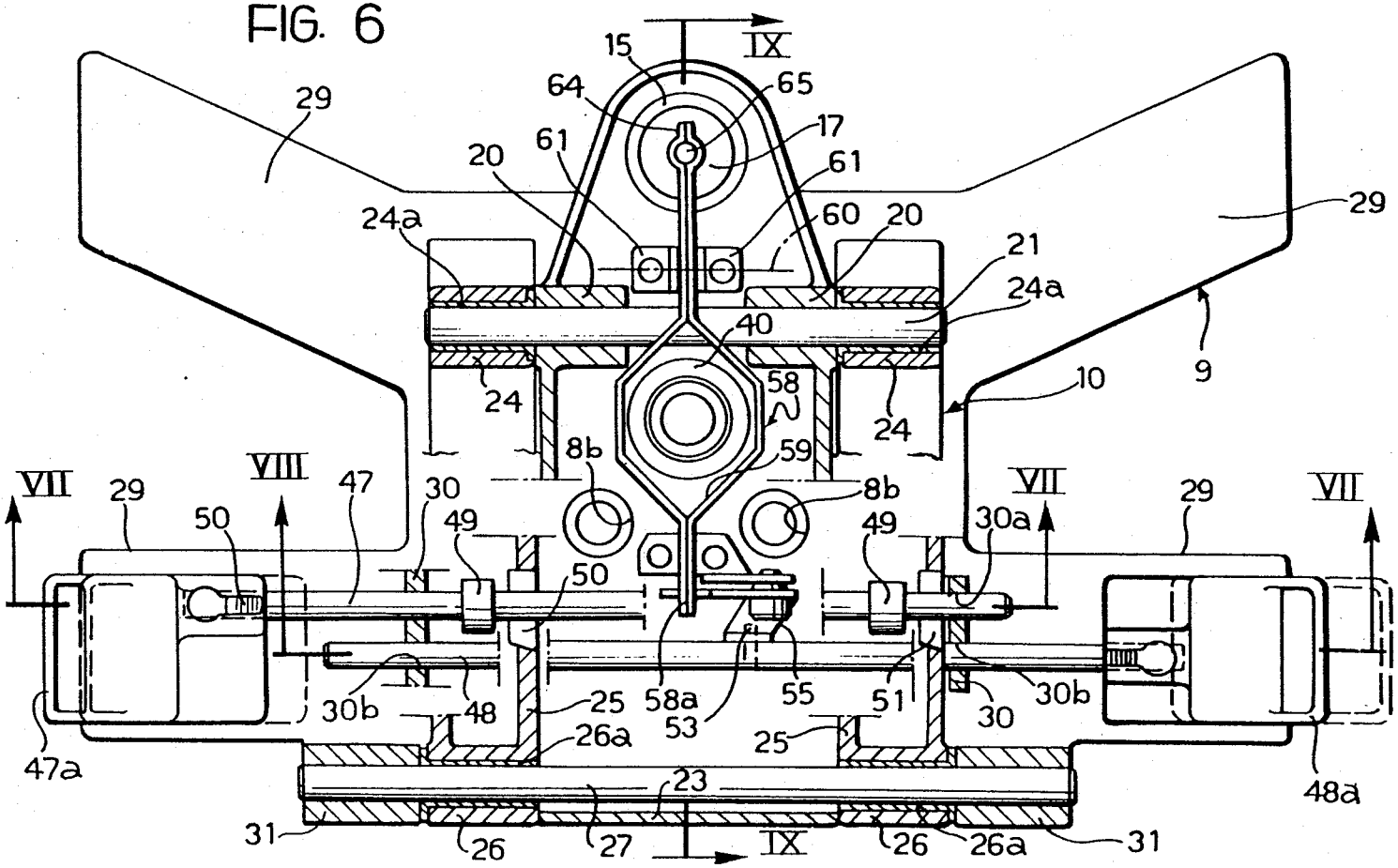
Figure 7:
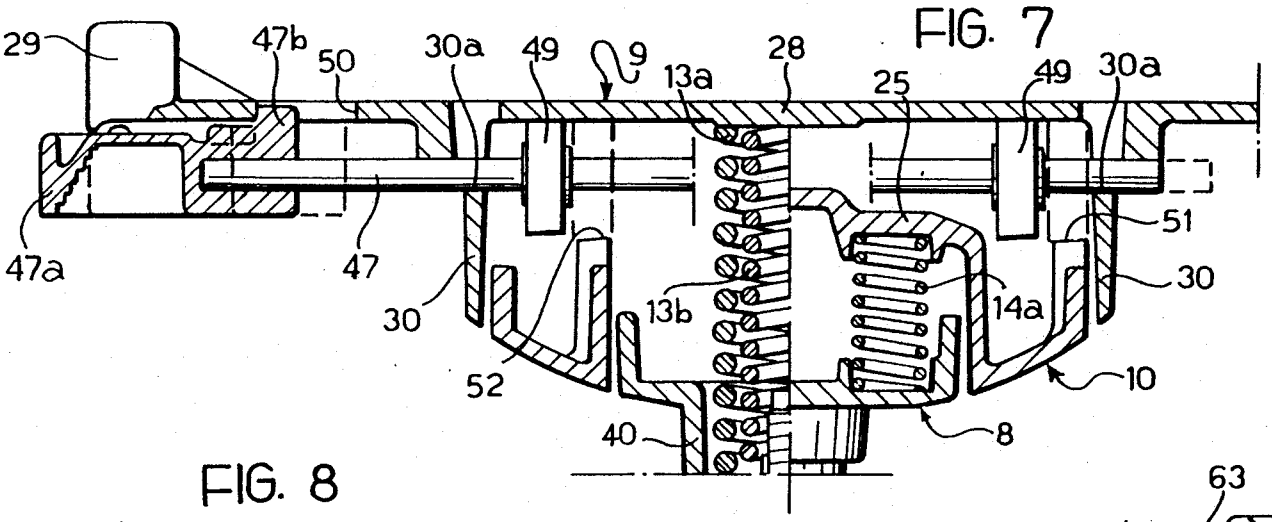
Figure 8:
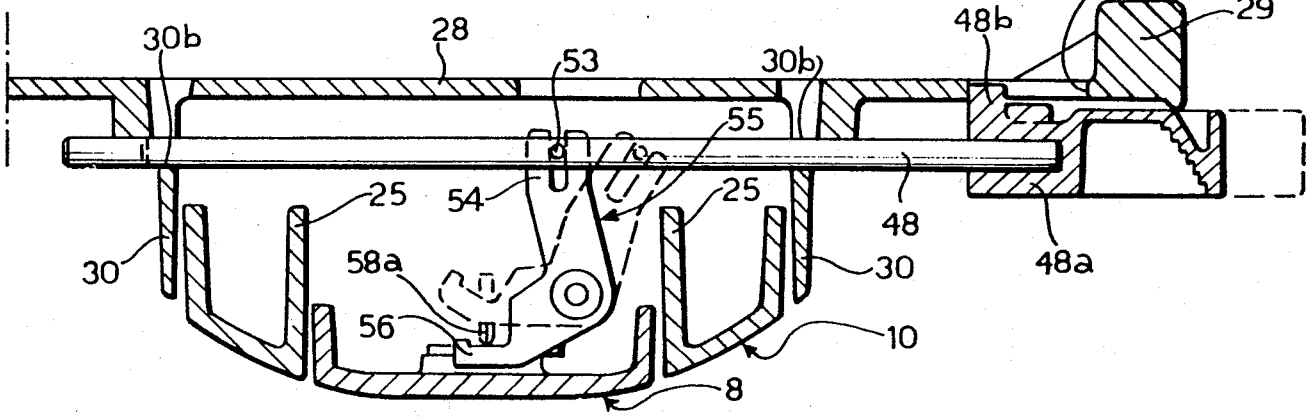
Figure 9:
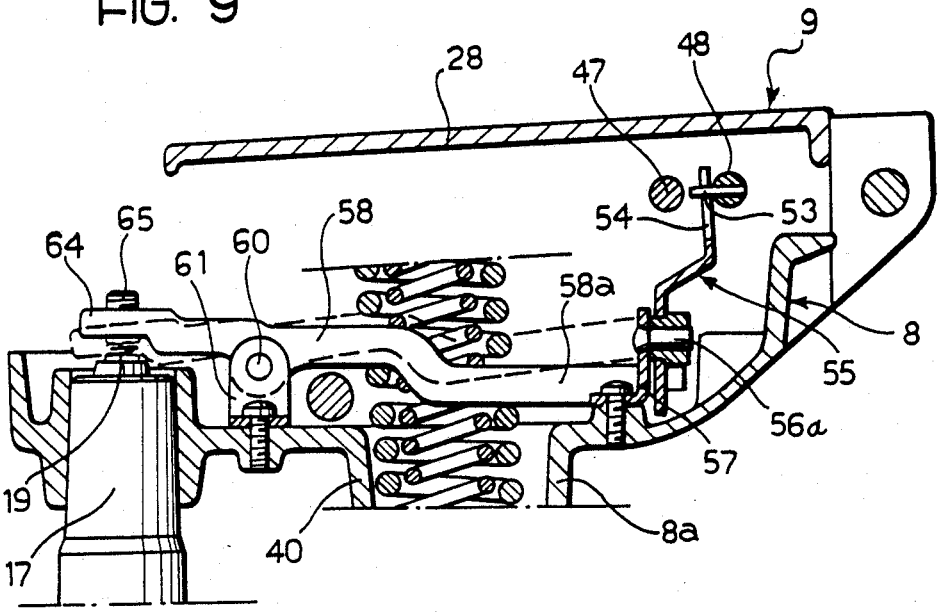
Figure 10:
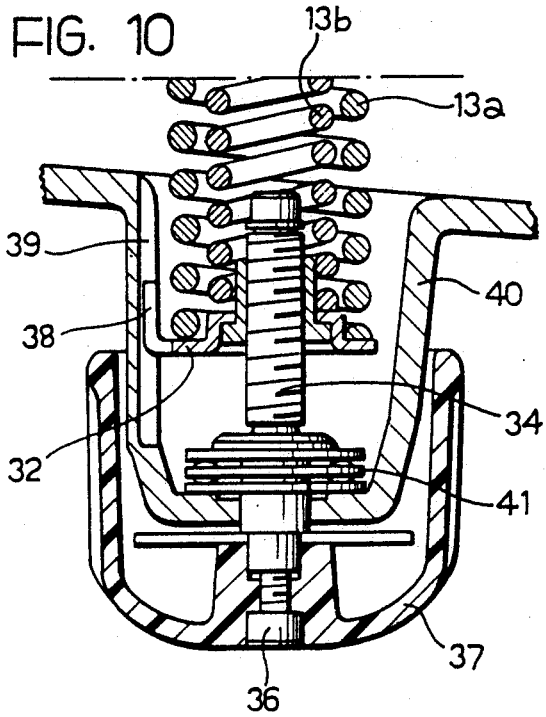

Further characteristics and advantages of the present invention will become clear from the detailed description which follows with reference to the appended drawings, provided by way of non-limiting example, in which:

FIG. 1 shows schematically the operating principle of the pivoting support according to the invention FIG. 2 is an exploded perspective view of a preferred embodiment of the pivoting support according to the invention, FIG. 3 is a section of the support of FIG. 2 in a first operating condition, FIGS. 4 and 5 show the support of FIG. 3 in two different operating conditions, FIG. 6 is a partially-sectioned plan view of the support of FIG. 2, FIGS. 7 and 8 are sections taken on the lines VII—VII and VII—VIII of FIG. 6, FIG. 9 is a section taken on the line IX—IX of FIG. 6, FIG. 10 shows the detail indicated by the arrow X in FIG. 3 in a different operating condition, and FIG. 11 a partially-sectioned perspective view of the detail indicated by the arrow XI in FIG. 2.

FIG. 1 shows a chair 1 having a seat 2 which is connected to a base structure 3 by means of a pivoting support which is generally indicated 4. The embodiment illustrated relates to the case in which the base structure 3 of the chair includes a central column 5 provided at its lower end with struts 6 having wheels 7. It is clear, however, that the pivoting support according to the invention can also be adapted to chairs which have a different base structure from that illustrated in FIG. 1. Similarly, the chair illustrated by way of example in FIG. 1 is of the integral type, in which the seat and backrest are rigidly connected to each other. It is obvious, however, that the support according to the invention can also be adapted to chairs having a more complex structure and particularly to chairs with backrests which are movable relative to the seats. A preferred application of the pivoting support according to the invention is constituted by the chair which forms the subject of the previous Italian utility model application No. 53523-B/86 by the same Applicant.

The pivoting support 4 comprises a main support member 8 which is connected to the base structure 3 of the chair, a seat support member 9, and an auxiliary support member 10 interposed between the main support member 8 and the seat support member 9. The auxiliary support member 10 is articulated to the main support member 8 about a first horizontal axis 11 which is perpendicular to the vertical plane of symmetry of the chair. The auxiliary support member 10 is also articulated to the seat support member 9 about a second horizontal axis 12 which is parallel to and in front of the axis 11. First resilient means 13 are interposed between the member 8 and the member 9 for biasing the member 9 towards a position in which it is rotated upwardly relative to the member 10. This position is defined by the engagement of stop elements 9*a*, 10*a* which cooperate with each other and are carried by the member 9 and the member 10 respectively. Second resilient means 14 are also interposed between the member 8 and the member 10 for biasing the member 10 towards a position in which it is rotated upwardly relative to the member 8. This position is defined by the engagement of stop elements 8*c*, 10*b* which cooperate with each other and are carried by the member 8 and the member 10 respectively.

FIG. 1 shows the chair in its normal position of use. By the displacement of its own weight, the user can pivot the seat 2 backwards by downward rotation of the member 9 relative to the member 10, overcoming the action of the resilient means 13. At this stage, the resilient means 14 keep the member 10 in the position illustrated. Alternatively, by the displacement of his own weight, the user can pivot the seat 2 forwards from the position illustrated in FIG. 1 by downward rotation of the member 10 relative to the member 8, overcoming the action of the resilient means 14 and 13.

In the preferred embodiment of the pivoting support according to the invention, which is illustrated in FIGS. 2 to 11, the main support member 8 is constituted by a fairly elongate cup-shaped body of aluminum alloy. At its rear end, the body incorporates an integral bush 15 with an aperture 16 for mounting on the top of the support column 5. In the embodiment illustrated, the main support member 8 is connected to the upper end 17 of a variable-length cylinder 18 carried by the base structure of the chair and intended to enable the height of the seat to be varied. The structure of the cylinder 18 is not described in detail in the present description and in the appended drawings, since this cylinder is of the known type including a gas spring and valve means for varying the height of the cylinder, which are operated by a push-button 19 projecting from the top surface of the cylinder. The bush 15 is fitted onto the end 17 of the cylinder and clamped by some clamping means, for example by screws (not illustrated).

Immediately in front of the bush 15, the body 8 includes two lateral bushes 20 whose holes are aligned along the first horizontal axis 11. The bushes 20 are engaged by an articulation pin 21 which is used for the articulation of the auxiliary support member 10. As shown in FIG. 2, the auxiliary support member 10 is constituted by a body having a generally U-shaped configuration, for example of aluminum alloy, including two lateral arms 22 connected by a front cross member 23. The rear ends of the lateral arms 22 incorporate integral bushes 24 which are engaged by the articulation pin 21 with the interposition of bushes 24*a* of plastics material (see FIG. 6). The auxiliary support member 10 is arranged astride the main support member 8 and the two bushes 24 are arranged outwardly of the two bushes 20 forming part of the member 8. The structural details of the axial clamping of the articulation pin 21 relative to the bushes 20 and 24 are not illustrated since, on the one hand, these details are known and, on the other hand, their elimination from the drawings renders the latter simpler and more easily understood. The same is true of the following part of the description which relates to the various articulated connections provided in the support according to the invention.

In the embodiment illustrated in FIG. 2, the second resilient means 14 (FIG. 1) are constituted by two helical springs 14*a* interposed between the base wall 8*a* of the support member 8 and a bridge member 25 interconnecting the two arms 22 of the auxiliary support member 10. The base wall 8*a* has two seats 8*b* for housing the lower ends of the springs 14*a*. The auxiliary support member 10 has two lateral bushes 26 (see FIG. 6) in correspondence with its front part.

The bushes 26 have holes which are aligned along the axis 12 and, with the interposition of bushes 26*a* of plastics material, accommodate a pin 27 for the articulation of the auxiliary support member 10 to the seat support member 9. The latter is constituted by a body of aluminum alloy including a central part 28 from which two pairs of lateral appendages 29 with four coplanar horizontal top surfaces 29*a* project. The seat of the chair is fixed to the four surfaces 29*a* by means of screws which engage vertical holes 29*b* provided in these surfaces. On its lower side, the seat support member 9 has two parallel vertical flanges 30 which are situated at the two sides of the auxiliary support 10. The support 9 has two bushes 31 at the front which are engaged by the articulation pin 27 and are situated outwardly of the front cross member 23 of the member 10. Two coaxial helical springs 13*a*, 13*b* are interposed between the central part 28 of the seat support member 9 and the base wall 8*a* of the main support member 8 and constitute the first resilient means 13 (FIG. 1). As can be seen in FIGS. 3 and 4 in particular, the lower ends of the helical springs 13*a*, 13*b* bear on an annular disc 32 which is mounted around a nut 33. The threaded hole of the nut 33 is engaged by a screw 34 to the head 35 of which a knob 37 is fixed by means of an auxiliary screw 36. This knob bears on a washer 37*a* which in turn bears on an annular frontal abutment surface of the body of the screw 34. The annular disc 32 has an axial peripheral appendage 38 which is slidably mounted in an axial groove 39 of a cup-shaped part 40 formed integrally with the base wall 8*a* of the element 8, in which the lower ends of the springs 13*a*, 13*b* are housed. The annular disc 32 is connected for rotation with the nut 33, so that the engagement of the appendage 38 in the groove 39 prevents rotation of the nut 33. Finally, a ball thrust bearing 41 is interposed between the base of the cup-shaped portion 40 and a ring 42 fixed to the screw, so as to prevent sliding on the lower surface of the cup-shaped portion 40. By virtue of the above-described structure and arrangement, the load of the helical springs 13*a*, 13*b* can easily be adjusted by acting on the knob 37. A rotation of this knob actually causes a corresponding rotation of the screw 34 and consequent axial displacement of the nut 33. The axial displacement of the nut 33 causes a corresponding displacement of the annular disc 32 and a variation of the load of the springs 13*a*, 13*b*. FIG. 3 shows the springs in the condition of minimum load, relating to the position of normal use of the pivoting support. FIG. 10 shows the springs in a condition of increased load, corresponding to a raising of the nut 33 with the annular disc 32.

The springs 14*a* bias the auxiliary support member 10 towards a position in which it is rotated upwardly (about the pin 21) relative to the main support member 8. This position is defined by the mutual engagement of the stop elements 8*c*, 10*b* carried by the member 8 and the member 10 respectively. With reference to FIGS. 2 and 3, the stop element 8*c* is constituted by a frontal lip of the body of the support member 8 and by a frontal wall of the support member 10, provided with a rubber pad 10*d*.

The springs 13*a*, 13*b* bias the seat support member 9 towards a position in which it is rotated upwardly (about the articulation pin 27) relative to the auxiliary support member 10. This position is defined by the mutual engagement of the stop elements 10*a*, 9*a* (see also FIG. 11). The stop elements 10*a* are constituted by two tabs projecting rearwardly from the bushes 24 of the auxiliary support member 10. The stop elements 9*a* are constituted by the base walls of two vertical appendages 43 projecting downwardly from the rear part of the seat support element 9. The walls 9*a* are provided with rubber pads 9*c*.

FIG. 3 shows the pivoting support according to the invention in the configuration which corresponds to the position of normal use of the chair. In this position, as already stated, the springs 13*a*, 13*b* and 14*a* keep the members 9, 10 in their upwardly rotated positions.

FIG. 4 shows the support in the configuration which corresponds to maximum backward pivoting of the chair. This position is defined by the engagement of a rubber pad 44 carried at the rear by the lower surface of the seat support member 9 on a flat abutment plane 45 provided above the bushes 20 of the main support member 8. Backward rotation of the chair is achieved by the user by the backward displacement of his own weight. This causes downward rotation of the support member 9 about the pin 27 relative to the auxiliary support member 10 which at this stage remains in its normal position. The backward pivoting of the seat thus takes place by the overcoming of the reaction of the helical springs 13*a*, 13*b*. The user can adjust the load of these springs with the knob 37, so as to obtain the desired degree of comfort.

FIG. 5 shows the support in the configuration which corresponds to maximum forward pivoting of the seat. This position is defined by the engagement of a rubber pad 46 carried under the front part of the seat support member 9 on the upper surface of the frontal lip 8*c* of the main support member 8. Forward pivoting of the seat is achieved by the user by the displacement of his own weight so as to cause a downward rotation of the auxiliary member 10 about the articulation pin 21 on the main support member 8. At this stage, the seat support element 9 continues to be kept in its most raised position relative to the auxiliary member 10, so that the stop elements 9*a*, 10*a* continue to be kept in contact with each other.

With reference to FIGS. 2 and 6–9, the two vertical flanges 30 of the seat support member 9 have two pairs of aligned holes 30*a*, 30*b* in which two shafts 47, 48 are slidably mounted. At its end which projects towards the right of the seat support member 9, the shaft 47 carries a handle 47*a* incorporating an upper peg 47*b* which slidably engages a slot 50 (see FIG. 2 and 7) formed in the wall of the member 9. The shaft 47 carries two wedges 49 which are adapted to be interposed (see the positions indicated by broken lines in FIG. 7) between the lower surface of the main wall 28 of the seat support member 9 and two inclined surfaces 51 and 52 formed on the upper surface of the auxiliary support member 10. When the operator acts on the handle 47*a* to cause displacement of the latter towards the central part of the seat, the wedges 49 are engaged in the aforementioned position to prevent the wall 28 and the surfaces 51 and 52 of the auxiliary support member 10 from moving towards each other. Backward pivoting of the seat is thus prevented. The wedging of the wedges 49 is naturally only possible when the support member 9 is not pivoted backwards.

With reference to FIGS. 2, 6 and 8, 9, the shaft 48 carries a handle 48*a* at its end which projects outwardly of the support, and is provided in one of its intermediate regions with a transverse pin 53 which engages a fork 54 formed at one end of a pivoted lever 55. The pivoted lever 55 is supported in an articulated manner by a pin 56*a* which is fixed to a bracket 57 (FIG. 9) screwed to the base wall 8*a* of the main support member 8. The end 56 of the pivoted lever 55 opposite the forked end 54 cooperates with a corresponding end 58*a* of a further pivoted lever 58. The pivoted lever 58 (FIG. 6) is formed by two sheet-metal strips which are welded together and define an aperture 59 in an intermediate region for the passage of the helical springs 13*a*, 13*b*. The pivoted lever 58 is articulated at 60 (FIG. 9) to a pair of brackets 61 (see also FIG. 6) screwed to the base wall 8*a* of the main support, member 8. The handle 48*a* also has an upper peg 48*b* engaged slidably in a slot 63 formed in the wall 28 of the seat support member 9. The pivoted lever 58 has an end 64 (FIGS. 6 and 9) provided with a threaded pin 65 which engages a threaded hole defined by the two sheet-metal strips forming the lever. The pin 65 is intended to cooperate with the push-button 19 for controlling the variable-length cylinder carried by the base structure of the chair. When the handle 48*a* is in its position nearest to the center of the seat, illustrated by a continuous line in the drawings, the end 64 of the pivoted lever 58 is raised and the variable-length cylinder is locked in a fixed configuration. An outward movement of the handle 48*a* causes displacement of the pivoted lever 55 into the position illustrated by a broken line in FIG. 8 and consequent displacement of the pivoted lever 58 into the position illustrated by a broken line in FIG. 9. This causes lowering of the end 64 provided with the threaded pin 65 over the control push-button 19. The variable-height cylinder is thus released and the operator can bring the seat to the required height and clamp it in its new position by returning the handle 48*a* to the original position illustrated by a continuous line in FIG. 8.

Naturally, the principle of the invention remaining the same, the forms of embodiment and details of constriction may be varied widely with respect to those described and illustrated purely by way of non-limiting example, without thereby departing from the scope of the present invention.

I claim:

1. A pivoting support for chairs, seats and the like having a base structure, comprising:

a main support member which is connected to the base structure, and a seat support member for pivoting about a horizontal axis, wherein the pivoting support further includes:

an auxiliary support member with the interposition of which the seat support member is connected to the main support member with the auxiliary support member being articulated to the main support member about a first horizontal axis and to the seat support member about a second horizontal axis which is parallel to and in front of the first horizontal axis, wherein the main support member has a cup-shaped body having a rear aperture which can be mounted on top of a support cylinder of the chair and having two lateral bushes which are aligned along the first horizontal axis, a pin for the articulation of the auxiliary support member being engageable in the lateral bushes, first resilient means interposed between the main support member and the seat support member for biasing the seat support member towards a position in which it is rotated upwardly relative to the auxiliary support member, and second resilient means interposed between the main support member and the auxiliary support member for biasing the auxiliary support member towards a position in which it is rotated upwardly relative to the main support element, wherein the cup-shaped body constituting the main support member has seats in its base for supporting helical springs constituting the first and second resilient means, and wherein the first resilient means are constituted by at least one helical spring and wherein the lower end of the spring bears on an element slidably mounted in a seat in the base wall of the main support member, a screw-and-nut control device being provided to move said element.

2. A pivoting support according to claim 1, wherein the screw-and-nut device includes a screw having one end which projects outwardly of the pivoting support and is provided with an operating knob, and a nut which is engaged by the screw and is prevented from rotating, the nut being connected to the element for supporting the lower end of the helical spring which constitutes the first resilient means.

3. A pivoting support for chairs, seats and the like having a base structure, comprising:

a main support member which is connected to the base structure, and a seat support member for pivoting about a horizontal axis, wherein the pivoting support further includes:

an auxiliary support member with the interposition of which the seat support member is connected to the main support member with the auxiliary support member being articulated to the main support member about a first horizontal axis and to the seat support member about a second horizontal axis which is parallel to and in front of the first horizontal axis, wherein the main support member has a cup-shaped body having a rear aperture which can be mounted on top of a support cylinder of the chair and having two lateral bushes which are aligned along the first horizontal axis, a pin for the articulation of the auxiliary support member being engageable in the lateral bushes, wherein the auxiliary support member has a generally U-shaped configuration and comprises two lateral arms, a cross member connecting the front ends of the two lateral arms, and two bushes provided at the rear ends of the lateral arms for the engagement of the articulation pin carried by the lateral bushes of the main support member, the U-shaped auxiliary support member being mounted astride the main support member with the two rear bushes arranged outwardly of the two lateral bushes of the main support member, first resilient means interposed between the main support member and the seat support member for biasing the seat support member towards a position in which it is rotated upwardly relative to the auxiliary support member, and second resilient means interposed between the main support member and the auxiliary support member for biasing the auxiliary support member towards a position in which it is rotated upwardly relative to the main support element.

4. A pivoting support according to claim 3, wherein the body constituting the auxiliary support member includes a bridge element which interconnects the two lateral arms, the second resilient means being constituted by two helical springs interposed between this bridge element and two seats formed in the base wall of the main support member.

5. A pivoting support according to claim 3, wherein the seat support member includes a main part provided at the front with two bushes having holes aligned along the second horizontal axis and arranged at the two outer sides of the front cross member of the auxiliary support member, and an articulation pin is carried by the bushes and engages a pair of bushes incorporated in the front cross member, the seat support member further including two pairs of lateral appendages projecting from the main part and terminating in ends for attachment to the lower surface of the seat of the chair.

6. A pivoting support for chairs, seats and the like having a base structure, comprising:

a main support member which is connected to the base structure, and a seat support member for pivoting about a horizontal axis, wherein the pivoting support further includes:

an auxiliary support member with the interposition of which the seat support member is connected to the main support member with the auxiliary support member being articulated to the main support member about a first horizontal axis and to the seat support member about a second horizontal axis which is parallel to and in front of the first horizontal axis, means for preventing backward pivoting of the seat support member, wherein the means for preventing backward pivoting of the seat support member comprise a pair of wedges carried by a shaft slidably mounted in the seat support member and adapted to be engaged between the seat support member and the auxiliary support member so as to prevent these members from moving towards each other, first resilient means interposed between the main support member and the seat support member for biasing the seat support member towards a position in which it is rotated upwardly relative to the auxiliary support member, and second resilient means interposed between the main support member and the auxiliary support member for biasing the auxiliary support member towards a position in which it is rotated upwardly relative to the main support element.

7. A pivoting support for chairs, seats and the like having a base structure, comprising: a main support member which is connected to the base structure, and a seat support member for pivoting about a horizontal axis, wherein the pivoting support further includes: an auxiliary support member with the interposition of which the seat support member is connected to the main support member with the auxiliary support member being articulated to the main support member with the auxiliary support member being articulated to the main support member about a first horizontal member and to the seat support member about a second horizontal axis which is parallel to and in front of the first horizontal axis, first resilient means interposed between the main support member and seat support member for biasing the seat support member towards a position in which it is rotated upwardly relative to the auxiliary support member, and second resilient means interposed between the main support member and the auxiliary support member for biasing the auxiliary support member towards a position in which it is rotated upwardly relative to the main support element, wherein the base structure of the chair carries a variable-length cylinder and the main support member is fixed to the top of the cylinder, and wherein the seat support member is provided with means for adjusting the variable-length cylinder, and wherein the variable-length cylinder has a control push-button, and wherein the means for adjusting the variable-length cylinder comprise a first lever rotatably mounted on the main support member for acting on the push-button, a second lever rotatably mounted on the auxiliary support member for acting on the first lever, a shaft slidably mounted in the seat support member for operating the second lever, and an operating handle carried by the shaft.

* * * * *